US007617703B2

(12) United States Patent
Osvatic

(10) Patent No.: US 7,617,703 B2
(45) Date of Patent: Nov. 17, 2009

(54) WASHING MACHINE LID LOCK WITH MEMORY WIRE ACTUATOR

(75) Inventor: Michael S. Osvatic, Waukesha, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 550 days.

(21) Appl. No.: 11/146,662

(22) Filed: Jun. 7, 2005

(65) Prior Publication Data

US 2006/0101869 A1 May 18, 2006

Related U.S. Application Data

(63) Continuation-in-part of application No. 10/982,008, filed on Nov. 5, 2004, now abandoned.

(51) Int. Cl.
*D06F 39/00* (2006.01)

(52) U.S. Cl. ..... 68/12.26; 70/91; 70/174; 70/277

(58) Field of Classification Search ..... None
See application file for complete search history.

(56) References Cited

U.S. PATENT DOCUMENTS 3,102,407 A * 9/1963 Stilwell, Jr. ..... 68/17 R
4,995,650 A * 2/1991 Schantz et al. ..... 292/201
5,831,417 A * 11/1998 Chu ..... 322/1
6,069,420 A * 5/2000 Mizzi et al. ..... 310/40 MM
6,410,886 B1 * 6/2002 Julien ..... 219/213
6,786,070 B1 * 9/2004 Dimig et al. ..... 70/277
2003/0020336 A1 * 1/2003 Gass et al. ..... 307/326
2004/0104580 A1 6/2004 Spiessl et al.

FOREIGN PATENT DOCUMENTS

DE 4100772 A1 * 7/1991

OTHER PUBLICATIONS

Roger G. Gilbertson, Muscle Wires Project Book, Mondo Tronics, Inc., 3rd Edition.

* cited by examiner

*Primary Examiner*—Michael Kornakov
*Assistant Examiner*—Eric Golightly
(74) *Attorney, Agent, or Firm*—Boyle Fredrickson, S.C.

(57) ABSTRACT

An actuator suitable for a washing machine lid lock employs a shape memory alloy wire indirectly heated by a temperature regulating heater that provides a sliding coupling to the wire and that may be driven, for example, directly by line voltage without the need for temperature regulation circuitry.

18 Claims, 3 Drawing Sheets

WASHING MACHINE LID LOCK WITH MEMORY WIRE ACTUATOR

CROSS-REFERENCE TO RELATED APPLICATIONS

This application is a continuation-in-part of U.S. application Ser. No. 10/982,008 filed Nov. 5, 2004 now abandoned and hereby incorporated by reference.

STATEMENT REGARDING FEDERALLY SPONSORED RESEARCH OR DEVELOPMENT

BACKGROUND OF THE INVENTION

The present invention relates to a lid lock for washing machines and more generally to a memory wire actuator useful for this and other applications.

During the spin cycle of a washing machine, water is removed from wet clothes centrifugally by spinning the clothes at high speed in a spin basket. In order to reduce the possibility of injury to the user, the washing machine lid, blocking access to the spin basket, may be locked in the closed position during the wash and spin cycle. Lid locks for this purpose are often designed to hold the lid closed for a period of time after the conclusion of the spin cycle or a power failure to allow the spinning basket time to halt.

This "time delay" feature can be provided in a lid lock by using a thermal element, such as a wax motor or a bimetallic strip, both of which can be heated electrically to actuate the lock, and then which must cool for a period of time after heating stops before it releases. Wax motors employ a piston and cylinder, the latter which contains wax or other expanding material. When the wax is heated, the piston is ejected from the cylinder to perform the necessary locking feature. As the cylinder cools, the piston is retracted under spring force. Heat may be applied to the wax motor through the use of a positive temperature coefficient (PTC) resistor glued to one face of the wax motor casing.

Bimetallic strips typically employ two dissimilar metals (e.g., having different coefficients of thermal expansion) laminated together so that heating of the strip causes the strip to curve and lock the lid. Bimetallic strips may be heated by passing electrical current directly through the metal of the strip, an approach that is not practical with wax motors, or by a PTC resistor attached to a portion of a flat side of the bimetallic strip.

Memory shape alloys are a class of alloys that can recover from strain when they are heated to a particular temperature. A wire form of memory shape alloy, known as "muscle wire", contracts several percent of its length when heated and can be used to provide a thermal actuator. Muscle wire is normally heated by passing a low current through its length. This process heats the entire length of the wire, maximizing its actuation length change, and yet does not interfere with the wire's expansion. Direct heating of the muscle wire also provides for fast response.

A significant obstacle to using muscle wire in commercial applications, such as in a lid lock for a washing machine, is the need to precondition the high voltage line power normally received by an appliance to a low voltage that may be applied to the muscle wire, and to regulate that voltage to eliminate overheating of the muscle wire that can damage its strain recovery properties.

BRIEF SUMMARY OF THE INVENTION

The present invention provides a thermal actuator suitable for use in a washing machine lid lock. The actuator makes use of a memory shape alloy wire but avoids the problems of power conditioning for the wire by independent heating of the wire using a separate heating element. Delay in actuation speed is reduced by direct contact between the heater and the wire using a sliding interface. The heating element may be tailored to operate at higher voltages than the wire and may be intrinsically self regulating, for example, a PTC resister. The heating element may also provide or be used with a greater thermal mass than the wire allowing independent control of thermal delay when power is removed.

Specifically then, the present invention provides an electromechanical actuator having a frame providing an anchor point and a shape memory alloy wire having a first end attached to the anchor point and having a second moving with respect to the anchor point caused by a change of length of the wire. An electrical heater is pressed against the shape memory alloy element with movement of the shape memory alloy element. A latch component, for example a lock, latch bolt or switch, is attached to the portion of the shape memory alloy wire to move therewith relative to the frame.

Thus, it is one object of at least one embodiment of the invention to enable practical use of a shape memory alloy wire for low cost, household appliance applications and the like. Use of a separate heater rather than resistive heating of the wire provides more consistent heating control and eliminates the possibility of hot spots in the wire caused by regions of high resistance. Direct contact between the heater and the wire provides fast response actuation.

The electrical heater may be a temperature regulating electrical heater. In one embodiment, the electrical heater may be a PTC resistor which is self-regulating.

It is therefore another object of at least one embodiment of the invention to avoid costly power regulation circuitry.

The shape memory alloy wire may be held in tension and deflected from a straight line by the heater so as to press against a thermally conductive surface of the heater.

Thus it is another object of at least one embodiment of the invention to provide a structure that allows close thermal contact of a heater with the wire without inhibiting movement of the wire required for actuation.

The thermally conducted surface may be bowed to promote contact between the wire and the thermally conductive surface.

Thus it is another object of at least one embodiment of the invention to provide close thermal contact with the heater while accommodating manufacturing tolerances and possible thermal distortion of the heater surface.

The thermally conductive surface may be one electrode of a PTC resister forming the electrical heater.

Thus it is another object of at least one embodiment of the invention to provide an extremely simple structure that combines electrode and heat conductive elements together and that provides for very low thermal resistance path between the wire and heater.

The positioning structure may hold the wire between the anchor point on the frame and the spring providing a tension on the wire.

It is thus another object of at least one embodiment of the invention to provide a certainty of contact of the wire with the thermally conductive surface throughout the wire's range of expansion and contraction.

The spring may be a leaf spring, or an over center spring mechanism, or a bistable element.

It is thus another object of at least one embodiment of the invention to provide a tensioning to the wire that provides a relativity flat or negative spring coefficient so as to improve the actuation distance provided by the shape memory alloy element.

The electromechanical actuator may include an electrical switch attached to the shape memory alloy element to be activated thereby or mechanical lock or both a switch and a lock.

Thus it is another object of at least one embodiment of the invention to provide an actuator particularly well adapted for use as a washing machine lid lock and similar applications.

The actuator may include a housing surrounding the shape memory alloy element and the shape memory alloy wire may be electrically isolated by the housing so that no electricity flows through the shape memory alloy wire.

Thus it is another object of at least one embodiment of the invention to eliminate the need for electrical isolation of the wire from the heater element such as may decrease thermal contact.

The actuator may include a thermal store holding the shape memory alloy wire in a heated state, for example, when the wire holds the lock engaged with a latch strike after electricity is no longer applied to the electrical heater for a period of time. This period of time may be adjusted to exceed the period of time required to initially engage the lock after the application of electrical energy to the electrical heater.

Thus it is another object of at least one embodiment of the invention to create a latch which may provide significant thermal delay without the need for thermal mass in the wire itself.

The shape memory alloy element may be a nickel titanium alloy. The shape memory alloy element may be a wire that contracts with heating.

It is another object of at least one embodiment of the invention to provide a design that may use an extremely small amount of relatively expensive shape memory alloy. By operating tension mode rather than in compression or bending modes, greater forces can be obtained with little material.

The shape memory alloy element may be a Flexinol wire.

Thus it is another object of at least one embodiment of the invention to provide an alloy that may be used in repeated cycles without loss of effectiveness.

These particular objects and advantages may apply to only some embodiments falling within the claims and thus do not define the scope of the invention.

DETAILED DESCRIPTION OF THE PREFERRED EMBODIMENT

Figure 1:
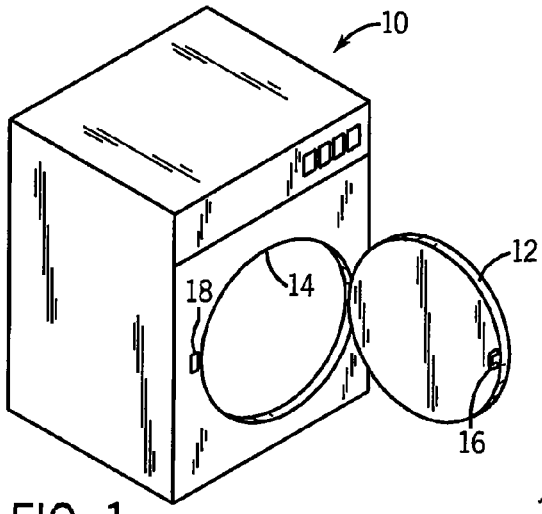
FIG. 1 PRIOR ART
FIG. 1 is a simplified perspective view of a top loading washing machine showing the location and external components of a lid lock such as may be implemented with the present invention.

Referring now to FIG. 1, a standard top-loading washing machine 10 includes a lid 12 that may be closed to cover a spin basket 14. A latch bolt 16 may extend downward from one edge of the lid 12 to be received by a lock mechanism 18 in the housing of the washing machine 10.

Figure 2:
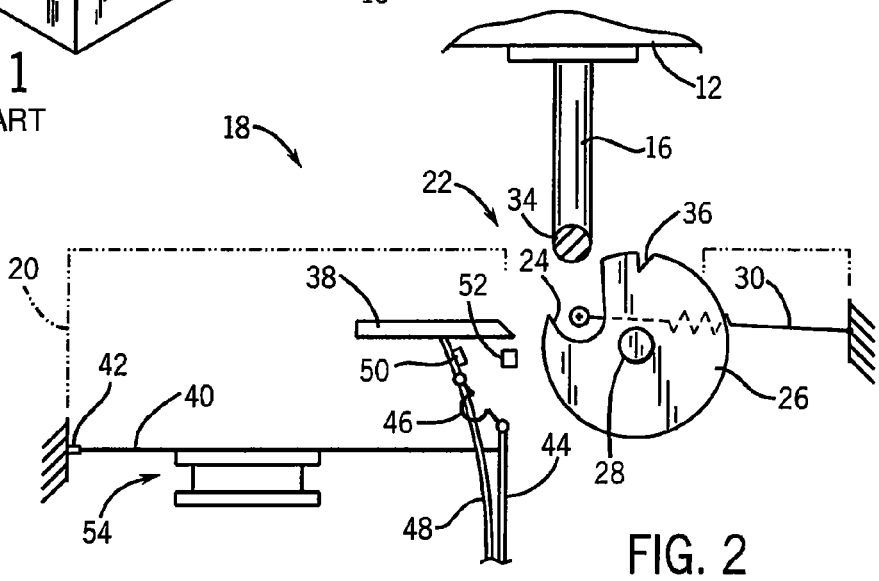
FIG. 2 is a simplified schematic representation of the elements of the lock of FIG. 1 showing a shape memory alloy wire such as communicates with a switch and a lock for immobilizing a bolt shown positioned above a strike prior to closing of the lid.

The bolt 16 extending downward from the lid 12 may enter an opening 22 in the casing 20 to be received by a bolt-receiving notch 24 in the periphery of the rotating strike 26, the latter rotating about an axis 28. An extension spring 30 attached between the casing 20 and the rotating strike 26 near the bolt-receiving notch 24, biases the rotating strike 26 fully in a clockwise mode as shown in FIG. 2 prior to receiving the bolt 16.

Figure 3:
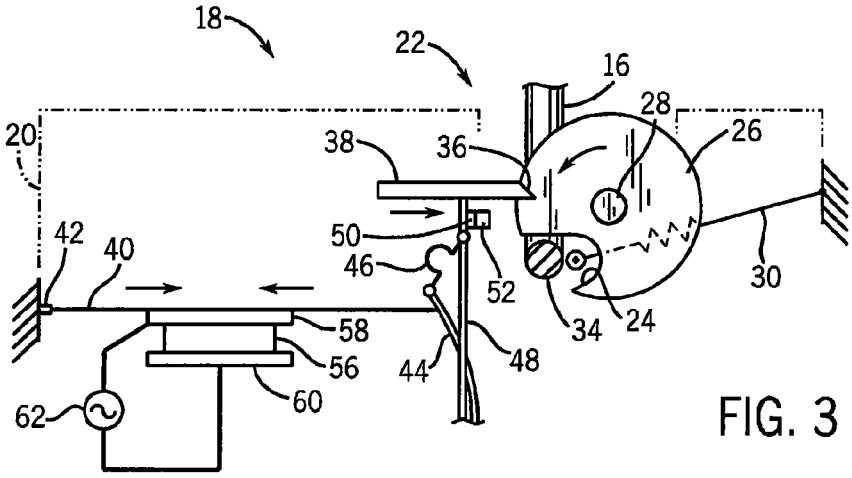
FIG. 3 is a figure similar of that of FIG. 2 showing the bolt after closing of the lid and activation of the shape memory alloy wire to lock the strike.

Referring now to FIG. 3, the bolt 16 moves along a substantially vertical axis as the lid 12. When the bolt 16 is fully inserted into the housing opening 22 a bottom lip 34 of the bolt 16 engages the bolt-receiving notch 24 in the rotating strike 26 turning the rotating strike 26 in a counterclockwise direction about rotation axis 28. As the tensioned extension spring 30 crosses the rotation axis 28 of the rotating strike 26, it redirects its force to pull the rotating strike 26 in a fully counterclockwise position as shown in FIG. 3 with the lip 34 of the bolt 16 captured under a surface of the bolt-receiving notch 24 of the rotating strike 26.

Referring now to FIG. 3, the bolt 16 moves along a substantially vertical axis as the lid 12. When the bolt 16 is fully inserted into the housing opening 23, a bottom lip 34 of the bolt 16 engages the bolt-receiving notch 24 in the rotating strike 26 turning the rotating strike 26 in a counterclockwise direction about rotation axis 28. As the tensioned extension spring 30 crosses the rotation axis 28 of the rotating strike 26, it redirects its force to pull the rotating strike 26 in a fully counterclockwise position as shown in FIG. 3 with the lip 34 of the bolt 16 captured under a surface of the bolt-receiving notch 24 of the rotating strike 26.

At this time, a locking notch 36 also in the periphery of the rotating strike 26 aligns with a horizontally sliding lock 38 which may engage the locking notch 36. Engagement of the locking notch 36 and the horizontally sliding lock 38 prevents clockwise motion of the rotating strike 26 with force upward in the bolt 16, for example, caused by a person attempting to open the washing machine lid 12 while the spin basket is in motion.

Referring again to FIG. 2 the casing 20 contains a horizontally extending memory wire 40 being a nickel titanium alloy having a crystal structure so that when the wire 40 is heated, the wire 40 contracts along its length. Wire suitable for this invention is manufactured by Dynalloy Inc. of Costa Mesa, Calif. under the trade name FLEXINOL. The wire 40 in the preferred embodiment has a transition temperature of approximately 90 degrees centigrade.

Figure 6:
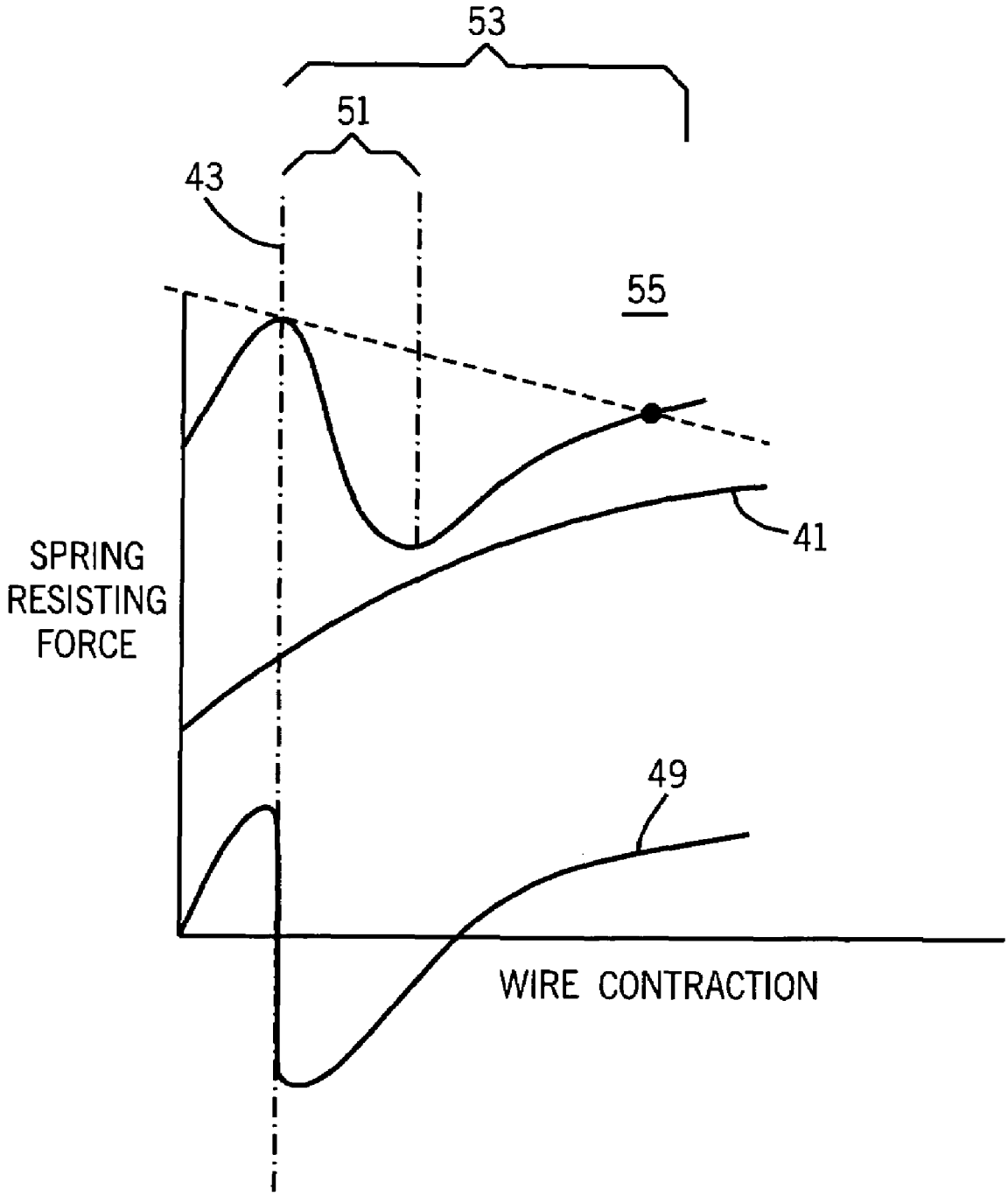
FIG. 6 is a chart showing the forces on the wire as it changes in length providing a negative spring coefficient.

A first end of the wire 40 is attached to the housing at an anchor point 42 and the second end of the wire 40 is attached to a leaf spring 44 extending generally perpendicularly to the length of the wire 40 and affixed at its lower end to the casing 20. Referring momentarily to FIG. 6, the leaf spring 44 provides tension to the wire 40 and a relatively constant leaf spring force 41 on the wire 40 as the wire 40 changes length. This flattening of the leaf spring force 41 is caused by a changing force vector of leaf spring 44 with respect to the wire axis as the leaf spring 44 bends which offsets some of the natural increase of leaf spring force 41 under bending of the leaf spring 44.

Referring again to FIG. 2, the end of wire 40 attached to leaf spring 44 attaches just beneath a free cantilevered end of the leaf spring 44. This free end of leaf spring 44 also pivotally attaches to a lower end of a C-spring 46 such as provides a compression spring element. The remaining upper end of the C-spring 46 attaches to a second leaf spring 48 generally parallel with the first leaf spring 44. In the preferred embodiment, the two leaf springs 44 and 48 are manufactured from the same spring strip with appropriate cutouts.

When wire 40 is in an unheated and thus elongated state, leaf spring 44 positions the lower end of C-spring 46 outboard of the upper end of C-spring 46 (away from wire 40) so as to push leaf spring 48 away from the rotating strike 26. The free cantilevered end of leaf spring 48 attaches to the sliding lock 38 and thus at this time moves the sliding lock 38 away from rotating strike 26.

Also attached to the cantilevered end of leaf spring 44 is a first contact 50 such as may communicate through leaf spring 44 to a terminal (not shown) that may attach to other circuitry. When wire 40 is in the unheated state, the contact 50 is held away from a second stationary contact 52 also attached to a terminal (not shown).

Referring now to FIG. 3, when wire 40 is heated, leaf spring 44 is pulled inward causing the lower end of the C-spring to move inboard with respect to its upper end reversing the biasing by the C-spring 46 on the leaf spring 48 causing the latter to bend toward rotating strike 26 moving sliding lock 38 into engagement with locking notch 36 and causing connection with contacts 50 and 52. Thus the contracting wire 40 serves to lock the lid 12 closed and to provide a positive signal through contact 50 and 52 that the lock 38 has in fact engaged. If the rotating strike 26 has not rotated to the position shown in FIG. 3, for example, because the lid 12 has not been fully closed, then the sliding lock 38 is not aligned with the locking notch 36 and cannot move sufficiently to the right to close contacts 50 and 52, being blocked instead by the periphery of the rotating strike 26. This provides an indication that the lid 12 is not properly locked.

The switch formed by contacts 50 and 52 is in general not wired to the circuit of the electrical heater 54 (to be described below) and is not used as part of the temperature control of the wire 40. Rather the switch provides electrical feedback to a washing machine control circuit to indicate that the lid 12 is safely locked. This switch status can only be achieved if the lid 12 has been closed and the rotating strike 26 is in a door-closed position.

Referring also to FIG. 6, as the lower end of the C-spring 46, the C-spring 46 compresses causing a C-spring force 49 that initially increases the tension on the wire 40 as the wire 40 contracts. The total force 55 on the wire 40 is the sum of the C-spring force 49 and the leaf spring force 41. As the point of attachment of the C-spring 46 and leaf spring 44 moves inboard crossing the leaf spring 48 at "overcenter" point 43 the total force 55 of the leaf spring 44 on the wire 40 drops abruptly because the reversal of the C-spring force 49 now pushes the leaf spring 44 toward the wire 40. This "over center spring" action causes a locally negative force coefficient in region 51 and a global negative force coefficient 53 greatly increasing the actuation distance provided by the wire 40. This is because the amount of length change in the wire is dependent on the tension applied to the wire 40. A negative force coefficient is one where force decreases with incremental movement against the direction of the force. Lower force may also increase the working life of the wire 40.

Referring generally to FIGS. 2 and 3, this heating of the wire 40 is indirect through an electrical heater 54 formed of the combination of a positive temperature coefficient (PTC) resistor 56 sandwiched between a first electrode 58 and a second electrode 60 across which line voltage 62 may be applied. Current flowing through the electrodes 58 and 60, and the PTC resistor 56, cause a heating of the PTC resistor 56 and this heat is conducted through the electrode 58 to the wire 40.

As is understood in the art, the PTC resistor 56 increases in resistance as a function of temperature, and thus for substantially constant electrical voltage will regulate its temperature by decreasing current flow as temperature rises. In the preferred embodiment, the PTC resistor 56 provides a regulated temperature of approximately 125-145 degrees centigrade when driven at a standard line voltage. Temperatures as high as 200 degrees centigrade can cause irreversible damage to the memory wire 40.

The broad area of the PTC resistor 56 and the heat spreading effect of the electrode 58 eliminates hot spots in the wire 40 that might occur with direct resistive heating of the wire 40 by passing a current through the wire 40. The PTC resistor 56 avoids the need to regulate or reduce voltage from typical line voltage levels in order to heat the wire 40 by receiving such line voltages directly without conditioning.

Electrode 58 is both electrically and thermally in contact with wire 40 and wire 40 is isolated by the insulating casing 20 and by the electrical insulating materials of the sliding lock 38 and rotating strike 26, and may be protected from bolt 16 by insulating wall (not shown) between leaf spring 44 and 48 and rotating strike 26 having an aperture for sliding lock 38.

Figure 4:
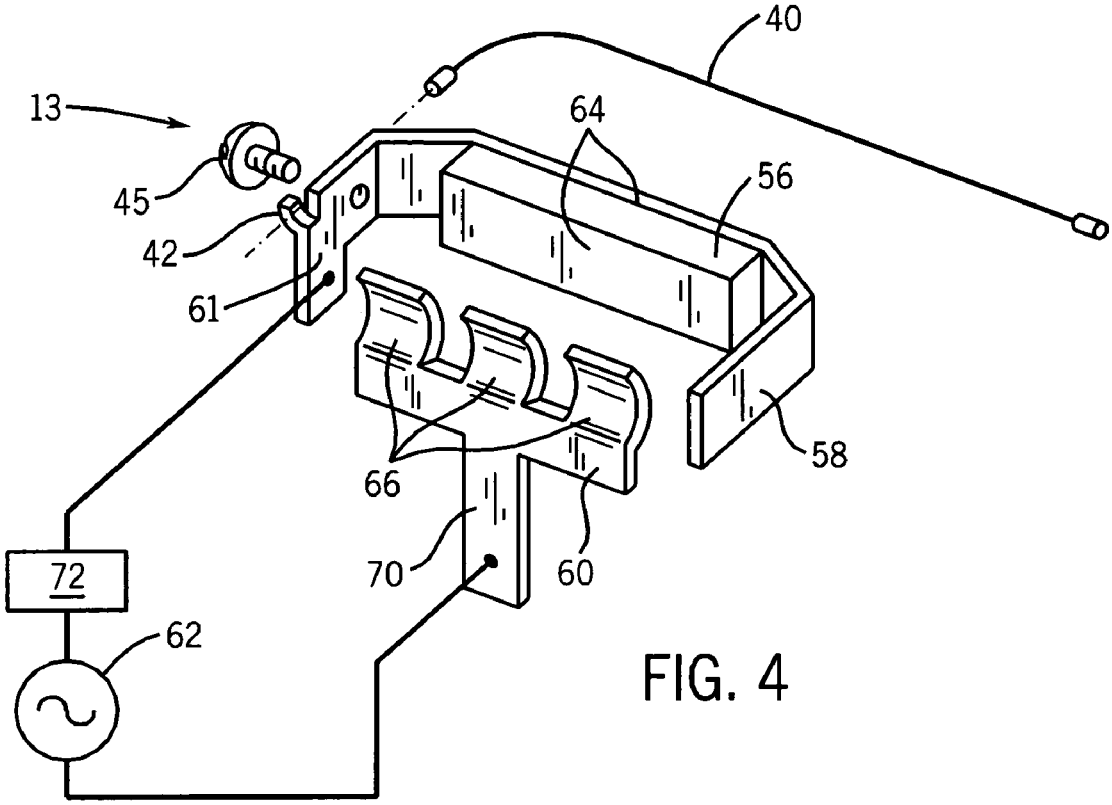
FIG. 4 is an exploded perspective view of the heater element used to heat the wire of FIGS. 2 and 3 showing a sandwiching of a PTC resister between two electrode elements.

Referring now to FIG. 4, electrode 58 may be a horizontally extending brass strip formed with a terminal 61 at one end, the latter which may protrude through the casing 20 to provide for electrical access to electrode 58. The PTC resistor 56 has integral electrodes surfaces 64 on its front and back faces one of which may abut an inner surface of electrode 60. The remaining integral electrode surface 64 of the PTC resistor 56 may contact spring fingers 66 of second electrode 60, then press the PTC resistor 56 inward against the first electrode 58. Second electrode 60 may likewise have downwardly extending terminal 70 that may extend through the casing 20 to be stabilized by the casing 20 and to be received by other circuitry.

One end of wire 40 may be anchored to an anchor point 42 at one end of the electrode 58 which in turn is attached to a frame formed by casing 20 to provide for an anchoring of the wire 40 to the casing 20. The remainder of the wire 40 may pass along the outer surface of electrode 58 to contact that surface for most of its length prior to attaching to leaf spring 44. The wire 40 may be terminated with crimped-on connectors, for example, crimped segments of concentric tubing or tabs folded over a trough to attach to the wire 40. These connectors may be received and retained by corresponding key slots or the like formed in the leaf spring 44 and electrode 58.

Figure 5:
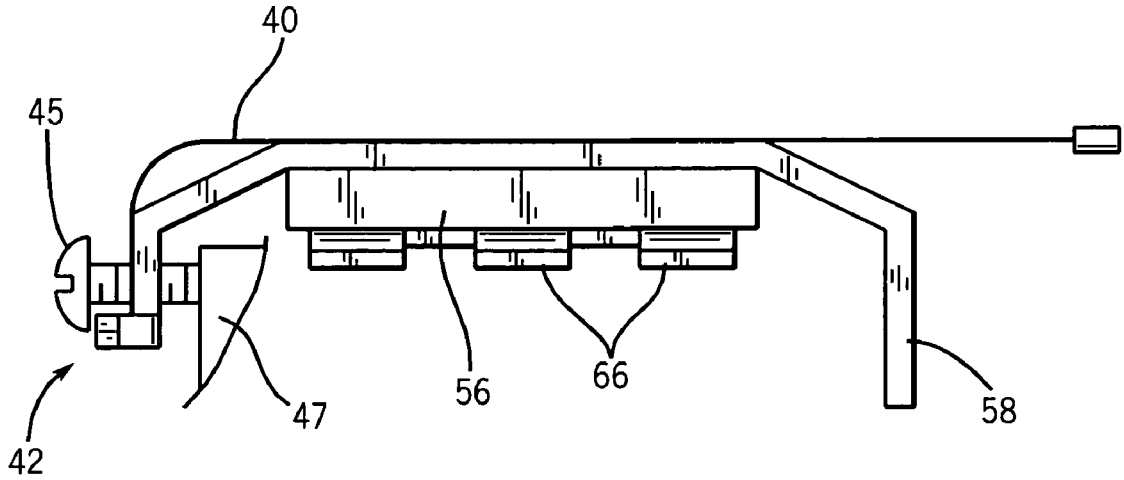
FIG. 5 is a top plan view of the assembled electrode and wire of FIG. 4 showing a bowing of one electrode such as provides a thermal contact surface engaging the wire in tension over a large area.

Referring to FIG. 5, the electrode 58 is bowed convexly outward except for a single substantially flat portion of abutting PTC resistor 56 and the wire 40 wraps partially around this outer convex surface of electrode 58 to ensure good thermal conductivity between electrode 58 and the wire 40 with relative movement between the two despite slight variation in the shape of the surface of electrode 58. The tension in the wire 40 causes a perpendicular force by the wire against the electrode 58 when the wire 40 is displaced from a straight line by the electrode 58. This perpendicular force allows good thermal contact between the heater formed by the electrode 58 and PTC resistor 56 and the wire 40 while allowing the wire 40 to slide with changes in length.

Although the wire 40 contacts the electrode 58 no current flows in the wire 40 because it is at equal potential along its length. Thus there is no risk of hot spots caused by variations in the resistance of the wire 40.

A screw 45 may pass through the electrode 58 near the anchor point 42 engaging the electrode 58 with its threads. An end of the screw 45 abuts stationary structure 47 on the casing 20 so that adjustment of the screw 45 causes a warping of the electrode 58 near the anchor point, changing the length of the outer convex surface of electrode 58 and thereby allowing adjustment of the location of the end of the wire 40 attached to leaf spring 44 (shown in FIG. 2), for corrections of tolerances or other adjustment purposes.

Referring again to FIG. 4, terminal 61 and terminal 70 may be connected to a source of line voltage 62 through timing circuitry 72, for example, the latter which may control energizing of the lock mechanism 18 during the wash and spin cycle and deactivate the lock mechanism 18 when the spin cycle is complete. Upon deactivation of the lock mechanism 18, by removing power from terminals 61 and 70, the electrode 58 and PTC resistor 56 provide a sufficient thermal mass to hold wire 40 above its transition temperature for a period of time suitable to allow the spin basket to cease rotation. This delay in unlocking will occur if the spin cycle has been completed or if there has been a power loss to the washing machine. It will be noted that the delay in unlocking is determined by heat loss from this thermal mass into the environment and may be, in the preferred embodiment, longer than the amount of time necessary to heat the electrode 58 and PTC resistor 56 to the transition temperature for locking, such as may be substantially independent of environmental heat loss. Thus the locking action may be fast and the unlocking action slower and the relative difference between these times flexibly controlled by changing the amount of thermal mass of the electrode 58 and/or controlling heat loss to the environment by insulation, vents, or heat sinks or other similar measures. This principle may be applied not only to the lock and switch described herein but also to other toggling mechanisms including for example latch bolts and the like.

While the present actuator had particular value and applications such as a lid lock where time delay is required, it will be recognized that the actuator is not limited to this application and may find application in other fields where simple robust and low cost actuation system must be designed. An important advantage in the use of a shape memory alloy for the wire 40 in this time delay application is that the contraction in length is a non-linear response that starts, for example, at about 70° C. and is finished by 75° C. while the expansion in length starts, for example, at about 50° C. and is finished by 40° C. This response, where the movement occurs in a small definable temperature range is of benefit for a device using cooling and heating for timing purposes in a toggling mechanism. In contrast, a similar response curve for a bi-metal material would be more nearly linear and as such it is very difficult to predict at what temperature or time an exact movement of a switch or latch will occur.

The latch component moved by the shape memory alloy wire may be a lock and/or switch as described or a latch bolt.

It is specifically intended that the present invention not be limited to the embodiments and illustrations contained herein, but include modified forms of those embodiments including portions of the embodiments and combinations of elements of different embodiments as come within the scope of the following claims.

I claim:

1. An electromechanical latch comprising:

a frame providing an anchor point;

a leaf spring having a first end attached to the frame and a second end spaced from the anchor point along an axis and so that the leaf spring extends substantially perpendicular to the axis;

a shape memory alloy wire having a first end attached to the anchor point and a second end attached to the second end of the leaf spring so that the wire extends along the axis, the shape memory alloy wire moving the second end of the leaf spring with respect to the anchor point upon heating of the shape memory alloy as the shape memory wire changes in length so that the leaf spring provides a tension to the shape memory alloy wire throughout the change in length of the wire;

an electrical heater pressed against the shape memory alloy wire while accommodating changes in length of the shape memory alloy wire;

a latch component slidable parallel to the axis;

a compression spring communicating between the second end of the leaf spring and the latch component to move the latch component with changes in length of the shape memory alloy wire;

wherein the shape memory alloy wire is held in substantially constant tension and deflected from a straight line by the electrical heater to press against a thermally conductive surface of the electrical heater in sliding contact.

2. The electromechanical latch of claim 1 wherein the thermally conductive surface is bowed to promote contact between the shape memory alloy and the thermally conductive surface.

3. The electromechanical latch of claim 1 wherein the thermally conductive surface is one electrode of a PTC resistor forming the electrical heater.

4. The electromechanical latch of claim 1 wherein the electrical heater provides a metallic conduction path from a resistive heater element to the shape memory alloy wire.

5. The electromechanical latch of claim 1 wherein the latch component is bistable.

6. The electromechanical latch of claim 1 wherein the latch component provides a negative force coefficient tension to the shape memory alloy.

7. The electromechanical latch of claim 1 wherein the latch component includes an overcenter spring mechanism providing tension on the shape memory alloy wire.

8. The electromechanical latch of claim 1 wherein the latch component is an electrical switch and wherein shape memory alloy wire attaches to the electrical switch to actuate the electrical switch.

9. The electromechanical latch of claim 1 wherein the shape memory alloy wire does not conduct electrical current.

10. The electromechanical latch of claim 1 wherein the shape memory alloy wire is a nickel titanium alloy.

11. The electromechanical latch of claim 1 wherein the shape memory alloy wire contracts with heating.

12. The electromechanical latch of claim 1 wherein the shape memory alloy wire has a transition temperature of approximately 90 degrees centigrade.

13. The electromechanical latch of claim 1 wherein the electrical heater is a temperature regulating electrical heater.

14. The electromechanical latch of claim 1 wherein the electrical heater is a positive temperature coefficient resistor.

15. The electromechanical latch of claim 1 wherein the frame includes an adjustment means for changing a location of a portion of the shape memory alloy wire with respect to at least a portion of the frame.

16. The electromechanical latch of claim 13 wherein the adjustment means is a screw warping a portion of the frame.

17. The electromechanical latch of claim 1 wherein the latch component is a lock engaging a latch strike after it has received a latch bolt.

18. The electromechanical latch of claim 15 including a thermal store holding the shape memory alloy wire in a heated state to hold the lock engaged with the latch strike after electricity is no longer applied to the electrical heater for a period of time exceeding a period of time required to heat the shape memory alloy wire to move the lock into engagement with the latch strike after application of electricity to the electrical heater.

* * * * *

UNITED STATES PATENT AND TRADEMARK OFFICE

CERTIFICATE OF CORRECTION

PATENT NO. : 7,617,703 B2
APPLICATION NO. : 11/146662
DATED : November 17, 2009
INVENTOR(S) : Michael S. Osvatic It is certified that error appears in the above-identified patent and that said Letters Patent is hereby corrected as shown below:

| | |
|---|---|
| Col. 4, line 19<br>(App. as filed 06-07-2005<br>Page 7, lines 8-11) | After "washing machine 10." insert --Referring to Fig. 2, the lock mechanism 18 may include a casing 20 attached to the housing of the washing machine 10. The casing 20 is preferably constructed of an electrically insulting thermoplastic so as to isolate the components inside the lock mechanism 18 as will be described.--, as a new paragraph. |
| Col. 4, line 30<br>(Amd. Dated 6/3/2008<br>Page 2 of 10, line 9) | Delete "22" and insert --22,-- therefor. |
| Col. 4, lines 39-49<br>(Amd. Dated 6/3/2008<br>Page 2 of 10, lines 8-14)<br>(Duplicate Paragraph) | Delete "Referring now to Fig. 3,...rotating strike 26.". |
| Col. 8, line 26, Claim 1<br>(NOA dated 07/13/2009<br>Pg. 2, Ex. Amd., lines 8-9) | Delete "axis;" and insert --axis; and-- therefor. |

Signed and Sealed this

Eleventh Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,617,703 B2
APPLICATION NO. : 11/146662
DATED : November 17, 2009
INVENTOR(S) : Osvatic It is certified that error appears in the above-identified patent and that said Letters Patent is hereby corrected as shown below:

On the cover page, (*) Notice: Subject to any disclaimer, the term of this patent is extended or adjusted under 35 U.S.C. 154(b) by 550 days.

Delete the phrase "by 550 days" and insert -- by 733 days --

Signed and Sealed this

Tenth Day of August, 2010

David J. Kappos

David J. Kappos
*Director of the United States Patent and Trademark Office*